340-552 SR
11/12/85 XR 4,553,135

United States Patent [19]
Grynberg et al.

[11] Patent Number: 4,553,135
[45] Date of Patent: Nov. 12, 1985

[54] ELECTROMAGNETIC FIELD PERIMETER DETECTION APPARATUS

[75] Inventors: Ami Grynberg, Neve Monosson; Ya'Acov Ronen, Rishon Le-Zion, both of Israel

[73] Assignee: Israel Aircraft Industries Ltd., Israel

[21] Appl. No.: 365,324

[22] Filed: Apr. 5, 1982

[30] Foreign Application Priority Data

Apr. 5, 1981 [IL] Israel ..... 62589

[51] Int. Cl.[4] ..... G08B 13/24
[52] U.S. Cl. ..... 340/564; 340/552; 343/894
[58] Field of Search ..... 340/552, 561, 564; 343/720, 894

[56] References Cited

U.S. PATENT DOCUMENTS

| | | | |
|---|---|---|---|
| 2,971,184 | 2/1961 | Pearson et al. | 343/894 |
| 3,047,849 | 7/1962 | Hansen | 340/564 |
| 4,027,303 | 5/1977 | Neuwirth et al. | 340/552 |
| 4,053,877 | 10/1977 | Torlesse et al. | 340/552 |
| 4,091,367 | 5/1978 | Harman | 340/552 |
| 4,174,518 | 11/1979 | Mongeon | 340/561 |
| 4,346,373 | 8/1982 | Hassman | 340/564 |

FOREIGN PATENT DOCUMENTS 2048536 12/1980 United Kingdom ..... 340/552

OTHER PUBLICATIONS

MERADCOM, (U.S. Army Publication), "Report on Sensor Study", Jul. 1, 1977, pp. 368–377.

*Primary Examiner*—Stewart J. Levy
*Assistant Examiner*—John E. Chapman, Jr.
*Attorney, Agent, or Firm*—Cushman, Darby & Cushman

[57] ABSTRACT

Detection apparatus comprising a plurality of elongate transmitting conductors each coupled to a source of electromagnetic energy and arranged for producing an electromagnetic field along the length thereof, at least one receiving conductor arranged alongside the plurality of transmitting conductors for sensing the electromagnetic field produced thereby, and alarm indicating circuitry coupled to the at least one receiving conductor for providing an alarm indication in response to a sensed disturbance of the electromagnetic field, the source of electromagnetic energy for each transmitting conductor comprising an AC voltage source of selected amplitude and phase, the selection of amplitude and phase determining the configuration of the overall electromagnetic field produced by the transmitting conductors, there being a non-zero phase relationship between the voltage sources of at least two of the transmitting conductors.

29 Claims, 7 Drawing Figures

ELECTROMAGNETIC FIELD PERIMETER DETECTION APPARATUS

FIELD OF THE INVENTION

The present invention relates to detection systems generally and more particularly to electronic detection systems which sense changes in an electromagnetic field produced by the presence of an object.

BACKGROUND OF THE INVENTION

A great variety of detection systems are known in the patent literature and are particularly suited for intrusion detection along a prescribed perimeter. One type of detection system used for this purpose is exemplified in the disclosures of U.S. Pat. Nos. 4,053,877 and 4,091,367 and employs a plurality of leaky co-axial cables which are arranged along the perimeter to be protected and preferably underground. RF signals are transmitted along one of the cables producing a corresponding signal in another one of the cables which is connected to a receiver. The presence of an intruder in the vicinity of the cables results in a change in the received signal, which change is sensed to provide an alarm indication.

The detection system described in U.S. Pat. No. 4,053,877 comprises a single transmitting cable and a pair of receiving cables which are arranged in parallel equally spaced relationship on opposite sides of the transmitting cable. The two receiving cables are connected to a differential transformer which subtracts the two received signals. An alarm signal is provided when the difference between the two signals exceeds a predetermined threshold, at a given time.

The detection system described in U.S. Pat. No. 4,091,367 comprises a pair of leaky coaxial cables which are alternatively coupled to transmitter and receiver circuitry. Apparatus is also provided for locating an intrusion along the length of the cables by sensing the elapsed time until a received signal is received. RF pulses of pulse width 400 nanoseconds and repetition rate 30 KHz are employed. An alarm signal is provided when the difference between the two signals exceeds a predetermined threshold at a given time.

Another type of detection system suitable for installation along a perimeter to be protected comprises an elongate cable which is coupled to a voltage source so as to produce an electric field about its length and a plurality of sensor cables disposed generally parallel to the field generating cable. The presence of an intruder causes the field sensed at any given time by the different sensor cables to change such that the output of a differential detector coupled to the sensor cables produces an alarm indication. A system of this type is illustrated in a publication of the U.S. ARMY, MERADCOM, entitled Report on Sensor Study, July 1, 1977 from pages 368–377. A similar system is shown in U.S. Pat. No. 4,174,518.

SUMMARY OF THE INVENTION

The present invention seeks to provide a detection system having features which are not known from the prior art, which features contribute to improved operational characteristics of the detection systems and economies in the manufacturing costs thereof.

There is thus provided in accordance with an embodiment of the present invention detection apparatus comprising a plurality of elongate transmitting conductors each coupled to a source of electromagnetic energy and arranged for producing an electromagnetic field along the length thereof, at least one receiving conductor arranged alongside the plurality of transmitting conductors for sensing the electromagnetic field produced thereby, and alarm indicating circuitry coupled to the at least one receiving conductor for providing an alarm indication in response to a sensed distubance of the electromagnetic field, the source of electromagnetic energy for each transmitting conductor comprising an AC voltage source of selected amplitude and phase, the selection of amplitude and phase determining the configuration of the overall electromagnetic field produced by the transmitting conductors, there being a non-zero phase relationship between the voltage sources of at least two of the transmitting conductors.

Additionally in accordance with an embodiment of the present invention there is provided detection apparatus comprising transmitter apparatus operative for producing an electromagnetic field in a protected region, receiver apparatus for detecting the electromagnetic field, the transmitter apparatus and the receiver apparatus defining a plurality of sensing zones, alarm indicating circuitry coupled to the receiver apparatus for receiving signals from the plurality of sensing zones and including apparatus for determining the time relationship between signals from the plurality of sensing zones, and apparatus for providing an alarm indication in response to receipt of at least two signals of similar shape having a non-zero time difference within predetermined limits.

Cross correlation function circuitry may be provided for providing the above alarm indication.

Additionally in accordance with an embodiment of the present invention elongate conductors such as leaky coaxial cables may be employed for transmission and receiving.

Further in accordance with an embodiment of the present invention the alarm indicating circuitry may comprise a digital memory for signal inputs. Additionally the alarm indicating circuitry may comprise a high resolution A–D converter having at least 18 bits of resolution.

DETAILED DESCRIPTION OF THE INVENTION

Figure 1A:
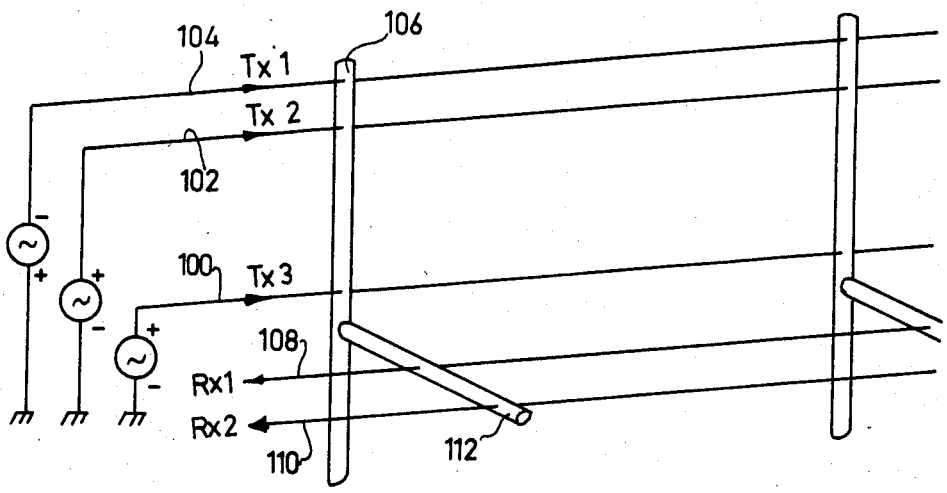
FIG. 1A is a schematic illustration of a detection system constructed and operative in accordance with a preferred embodiment of the present invention.

Reference is now made to FIG. 1A which shows a detection system constructed and operative in accordance with an embodiment of the present invention and which comprises three transmitting conductors 100, 102 and 104 which extend along a perimeter and are disposed in spaced relationship along a common vertical axis by means of posts 106. A plurality of receiving conductors, typically two in number and indicated by reference numerals 108 and 110 are disposed, typically in a horizontal plane perpendicular to the above-mentioned vertical axis, in mutually spaced relationship by means of supports 112 which may be mounted on posts 106.

According to a preferred embodiment of the present invention, transmitting conductors 100, 102 and 104 are each supplied with an AC voltage. The phase relationship of the voltages, their amplitudes and the relative position of conductors 100, 102 and 104 are selected so as to define a desired electric field within the vicinity of the conductors. It is a particular feature of the present invention that the geographical limits of the electric field are thus tailored to the environment such that objects occurring in nature such as trees whose movement could result in false alarms of the system are excluded from the region of detection.

The shape of the electrical field is determined by the phase relationship of the voltages, their amplitudes and the relative position of the transmitting conductors such that the electric fields produced by the individual conductors 100, 102 and 104 mutually cancel to within a desired tolerance outside the desired limits for the field.

Figure 2A:
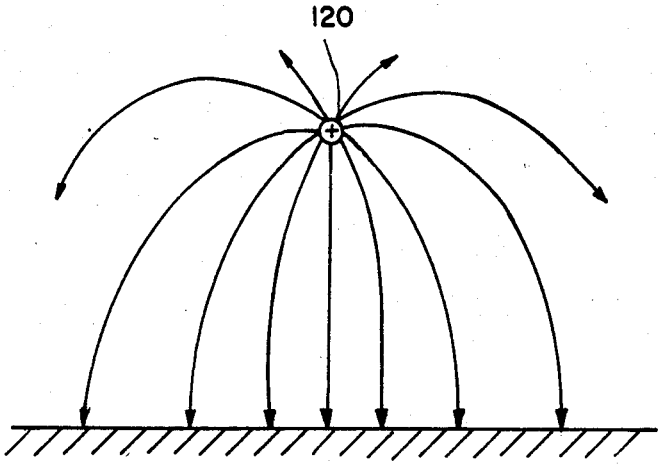
FIGS. 2A, 2B and 2C indicate three respective field configurations produced respectively by a single elongate transmitting conductor, two such conductors and three such conductors.
Figure 2B:
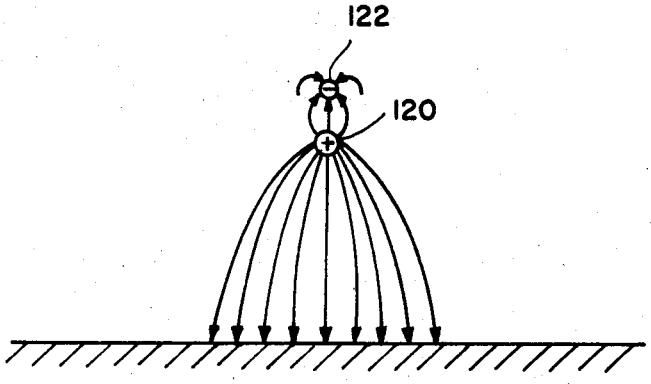
Figure 2C:
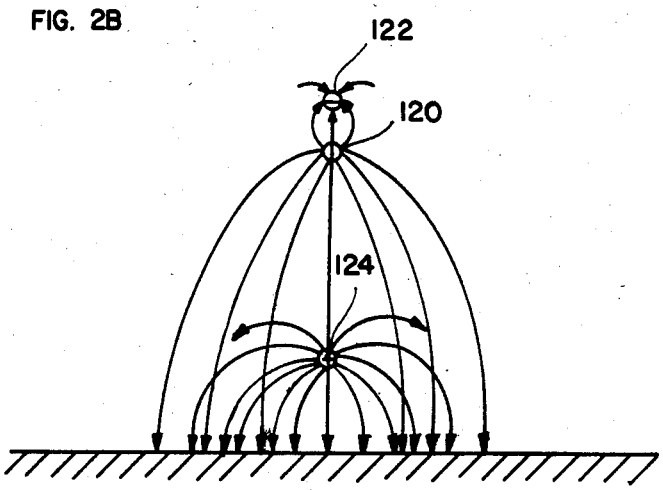

The operation and efficacy of the field-shaping technique employed in the apparatus of FIG. 1A will be appreciated from a consideration of FIGS. 2A–2C which illustrate field configurations for various conductor combinations. In FIG. 2A a single elongate conductor 120 is seen to provide a relatively wide field which extends also above the conductor. FIG. 2B shows that the addition of a second conductor 122, of phase opposite to that of conductor 120, significantly narrows the extent of the field transversely to the vertical axis and significantly limits its extent above conductor 120. FIG. 2C illustrates the addition of a third conductor 124 of the same phase as conductor 120, which increases the field density in the vicinity of the ground surface.

It is appreciated that the configurations and combinations illustrated in FIGS. 2A–2C are merely exemplary and that the teachings of the present invention are not limited to a particular combination of conductors but are directed to field shaping by the use of a plurality of conductors of desired relative spacing carrying AC signals of selected relative phase.

Figure 1B:
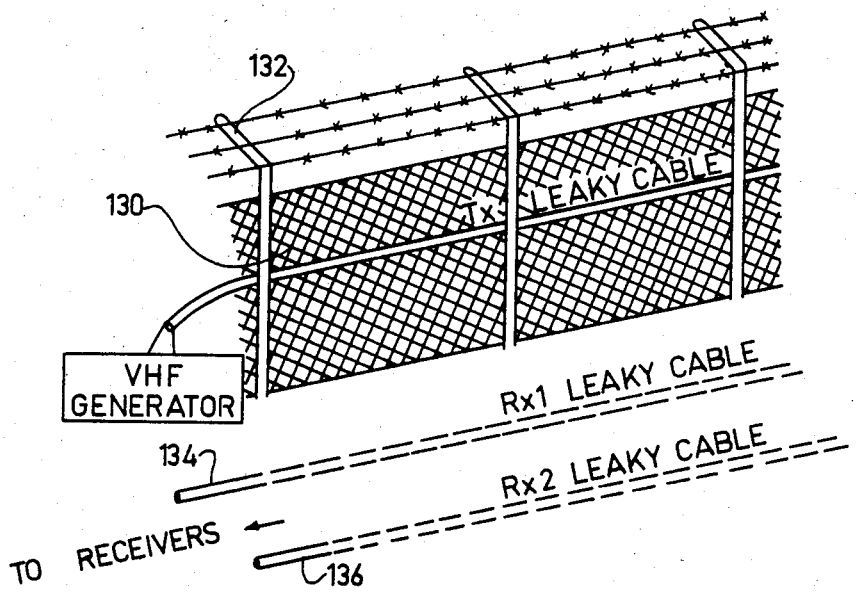
FIG. 1B is a schematic illustration of a detection system constructed and operative in accordance with another preferred embodiment of the present invention.

Reference is now made to FIG. 1B which illustrates detection apparatus constructed and operative in accordance with an alternative embodiment of the present invention and comprising a transmitter cable 130, typically suspended above the ground surface and mounted on a fence or other object 132. Transmitter cable 130 typically comprises a leaky coaxial cable such as a CERT® or RADIAX® cable. A pair of receiving cables 134 and 136 are buried under the ground surface on either side of the transmitter cable 130 and also comprise leaky coaxial cables. The receiving cables 134 and 136 are typically separated from each other by 1.5 meters. The transmission conductor may also be located below the ground surface.

It may be appreciated that in accordance with an alternative embodiment of the present invention more than one transmitter cable may be employed and one or more receiving cables may be employed. This is true also for the embodiment of FIG. 1A.

Figure 4:
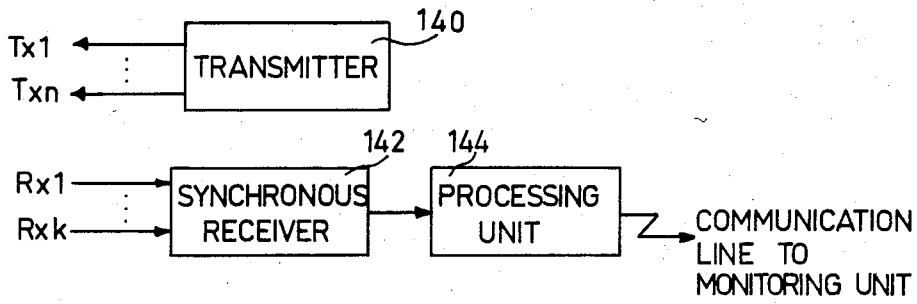
FIG. 4 is a block diagram of circuitry useful in the embodiments of the detection system illustrated in FIGS. 1A and 1B.

The operating circuitry used in the embodiments of the invention is illustrated in general block diagram form in FIG. 4 and comprises a transmitter 140 which provides an electrical signal along the transmitter cable or cables as the case may be and also provides a synchronization signal to a synchronous receiver 142. Receiver 142 receives electrical inputs from one or more receiving cables and provides an output to a processing unit 144 which in turn communicates with alarm indicating and monitoring apparatus via a communications link.

When used in the embodiment of FIG. 1A, the transmitter 140 comprises oscillator apparatus producing an AC signal of selected amplitude and phase for each of the transmitter cables. When used in the embodiment of FIG. 1B, the transmitter may comprise any suitable RF transmitter and preferably comprises a VHF generator operating in a pulsed continuous wave mode producing a signal of pulse width 1 ms and a duty cycle of 25 milliseconds.

The use of a pulsed continuous wave signal provides savings in energy requirements and enables establishment of a background interference noise level in the absence of transmission.

According to a preferred embodiment of the present invention, the processing unit 144 comprises cross correlation function circuitry which assists in distinguishing actual alarm indications from spurious signals resulting from a noisy environment and including signals resulting from natural phenomena such as wind, rain and lightening.

The cross correlation function is given by the expression:

$$y(t) = \int_{-A}^{A} F_1(t)F_2(t+\tau)dt$$

where y(t) is the correlation function $\tau$ is the delay between the two functions before correlation there of and A is the maximum delay and is related to the duration of the signals under test.

Thus according to a preferred embodiment of the present invention, the processing circuitry is operative to provide an output indication for alarm in the presence of two signals of similar shape which occur with non-zero correlation within predetermined time separation limits.

It is also a particular feature of the present invention that the processing unit comprises a digital memory for signal inputs. The provision of a digital memory enables signals having a very slow rate of change to be detected.

Figure 3:
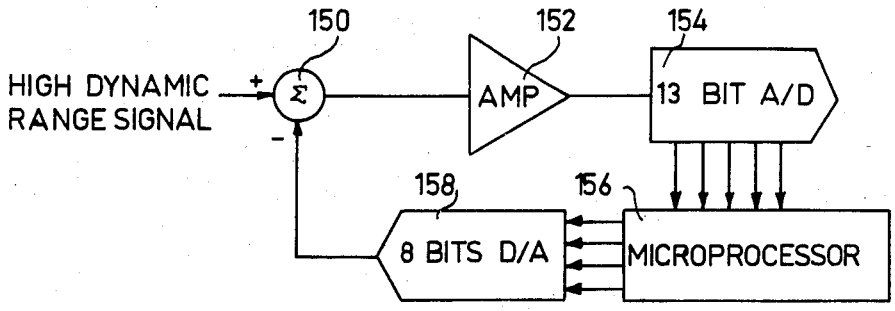
FIG. 3 is a block diagram illustration of a high resolution A–D converter useful in accordance with the present invention.

A very high resolution detection output is provided in accordance with an embodiment of the present invention by the use of an A–D converter providing up to 20 bits of resolution. The A–D converter is illustrated in FIG. 3 and comprises a subtraction circuit 150 which receives a high dynamic range signal from the receiver 142 (FIG 4). The output of the subtraction circuit 150, a DC voltage which is approximately equal to the DC value of the input signal supplied to the subtraction circuit is supplied via an amplifier 152 to an A–D converter 154, typically of 13 bit capacity. The output of the A–D converter 154 is supplied to a microprocessor 156 which governs the digital input to a D-A converter 158. The output of subtraction circuit 150 is a low dynamic range signal which represents the difference between the actual DC value of the input signal and its approximation by the A–D converter 154. A high resolution digital input to converter 158 is provided by microprocessor 156.

The digital output from the A–D converter is calculated to provide an output from the subtraction circuit which is within the linear range of operation of the analog to digital converter.

It is a particular feature of the present invention that due to the presence of the cross correlation circuitry, the apparatus illustrated in either of the embodiments of FIG. 1A or FIG. 1B is able to provide an alarm indication based on the sensed disturbance of an electromagnetic field in a plurality of sensing zones. These zones may be represented by a number of receiving cables in relation to one or more transmitting cables or alternatively one or more receiving cables in relation to a plurality of transmitting cables. The disturbances may thus result from a single event indicating an intrusion into a protected region or alternatively from a plurality of related events indicating a particular intrusion pattern. The sensing zones may or may not overlap.

The alarm indicating circuitry described above comprises digital circuitry having a resolution of less than one tenth of one percent of full scale. The pulsed continuous wave signal employed in the embodiment of FIG. 1B is characterized in that the pulse width is sufficiently long such that transient effects are substantially absent.

It will be appreciated by persons skilled in the art that the invention is not limited by what has been particularly shown and suggested herein. Rather the scope of the present invention is defined only by the claims which follow:

I claim:

1. Detection apparatus comprising:

at least one receiving conductor for sensing an electromagnetic field;

at least three mutually spaced elongate transmitting conductors each coupled to a source of electromagnetic energy and cooperating to produce a desired electromagnetic field along the length of said receiving conductor;

alarm indicating circuitry coupled to said at least one receiving conductor for providing an alarm indication in response to a sensed disturbance of said electromagnetic field, said source of electromagnetic energy for each transmitting conductor comprising an AC voltage source of selected amplitude and phase, the selection of amplitude and phase determining the configuration of the overall electromagnetic field produced by said transmitting conductors, there being a non-zero phase relationship between the voltage sources of at least two of said transmitting conductors.

2. Detection apparatus according to claim 1 and wherein said elongate transmitting conductors are arranged along a common plane.

3. Detection apparatus according to claim 1 and wherein said at least one receiving conductor comprises a plurality of receiving conductors.

4. Detection apparatus according to claim 3 and wherein said alarm indicating circuitry comprises a synchronous receiver coupled to said plurality of receiving conductors.

5. Detection apparatus according to claim 1 and wherein said alarm indicating circuitry comprises digital circuitry having a resolution of less than one percent of full scale.

6. Detection apparatus according to claim 1 and wherein said alarm indicating circuitry comprises digital circuitry having a resolution of less than one tenth of one percent of full scale.

7. Detection apparatus comprising:

receiver means for detecting an electromagnetic field;

transmitter means operative in an intermittent continuous wave mode for producing an electromagnetic field in a protected region, said transmitter means including at least three mutually spaced elongate transmitting conductors each coupled to a source of electromagnetic energy and cooperating to produce a desired electromagnetic field along the length of said receiver means;

said source of electromagnetic energy for each transmitting conductor comprising an AC voltage source of selected amplitude and phase, the selection of amplitude and phase determining the configuration of the overall electromagnetic field produced by said transmitting conductors, there being a non-zero phase relationship between the voltage sources of at least two of said transmitting conductors;

alarm indicating circuitry coupled to said receiver means and being operative to detect small changes in said electromagnetic field over a wide dynamic range.

8. Detection apparatus according to claims 1 or 7 and also comprising a digital memory for signal inputs which include indications of a sensed disturbance of said electromagnetic field.

9. Detection apparatus according to claim 1 and wherein said alarm indicating circuitry comprises amplifier means and high resolution analog to digital conversion means having at least 18 bits of resolution.

10. Detection apparatus according to claim 9 and wherein said analog to digital conversion means have 20 bits of resolution.

11. Detection apparatus according to claim 9 and wherein said analog to digital conversion means comprise:

a subtraction circuit receiving an analog input;

an amplifier receiving the output of said subtraction circuit;

an analog to digital converter receiving the output of said amplifier and providing a digital output;

computing means receiving said digital output from said analog to digital converter and providing a digital output which is calculated to provide an output from said subtraction circuit which is within the linear range of operation of the analog to digital converter; and a digital to analog converter receiving the digital output from said computing means and providing an analog output to an input of said subtraction circuit.

12. Detection apparatus according to claim 1 and wherein said transmitting and receiving conductors are located above the ground surface.

13. Detection apparatus according to claim 1 and wherein said transmitting and receiving conductors include conductors disposed above and conductors disposed below the ground surface.

14. Detection apparatus comprising:

a plurality of receiver means for detecting an electromagnetic field;

transmitter means operative for producing an electromagnetic field in a protected region, said transmitter means including at least three mutually spaced elongate transmitting conductors each coupled to a source of electromagnetic energy and cooperating to produce a desired electromagnetic field along the length of said receiver means;

said source of electromagnetic energy for each transmitting conductor comprising an AC voltage source of selected amplitude and phase, the selection of amplitude and phase determining the configuration of the overall electromagnetic field produced by said transmitting conductors, there being a non-zero phase relationship between the voltage sources of at least two of said transmitting conductors;

each of said receiver means defining a sensing zone;

alarm indicating circuitry coupled to said plurality of receiver means for receiving signals from said sensing zones and including;

means for determining the time relationship between signals from said sensing zones; and means for providing an alarm indication in response to receipt of at least two signals of similar shape having a non-zero time difference within predetermined limits.

15. Detection apparatus according to claim 14 and wherein said means for determining the time relationship comprises cross-correlation function circuitry for indicating a predetermined correlation of signals of similar shape having a non-zero time difference.

16. Detection apparatus according to claim 15 and wherein said signals from said plurality of sensing zones comprises at least first and second signals, each proportional to the strength of an intrusion disturbance in one of said plurality of sensing zones.

17. Detection apparatus according to claim 16 and wherein said first and second signals are produced by a single intrusion disturbance.

18. Detection apparatus according to claim 16 and wherein said first and second signals are produced by different intrusion disturbances associated with a single intrusion occurrence.

19. Detection apparatus according to claim 14 and wherein said receiver means comprises a plurality of receivers.

20. Detection apparatus according to claim 19 and wherein said alarm indicating circuitry comprises a differential receiver coupled to said plurality of receivers.

21. Detection apparatus according to claim 14 and wherein said receiver means comprise elongated conductors.

22. Detection apparatus according to claim 14 and wherein said sensing zones are overlapping.

23. Detection apparatus according to claim 14 and wherein said sensing zones are non-overlapping.

24. Detection apparatus comprising:

a plurality of receiving conductors for sensing an electromagnetic field;

at least three elongate transmitting conductors each coupled to a source of electromagnetic energy and cooperating to produce a desired electromagnetic field along the length of said plurality of receiving conductors;

said source of electromagnetic energy for each transmitting conductor comprising an AC voltage source of selected amplitude and phase, the selection of amplitude and phase determining the configuration of the overall electromagnetic field produced by said transmitting conductors, there being a non-zero phase relationship between the voltage sources of at least two of said transmitting conductors;

each of said receiving conductors defining a sensing zone;

alarm indicating circuitry coupled to said receiving conductors for receiving signals from said sensing zones and including;

means for sensing the time relationship between signals from said sensing zones; and means for providing an alarm indication in response to receipt of at least two signals having a non-zero time difference within predetermined limits.

25. Detection apparatus according to claim 24 and wherein said signals include signals produced by different intrusion disturbances associated with a single intrusion occurrence.

26. Detection apparatus according to claim 1 or claim 24 and wherein said conductors comprise leaky coaxial cables.

27. Detection apparatus comprising:

at least one receiver conductor for sensing an electromagnetic field;

at least three elongate transmitting conductors each coupled to a source of electromagnetic energy and cooperating to produce a desired electromagnetic field along the length of said at least one receiver conductor;

said source of electromagnetic energy for each transmitting conductor comprising an AC voltage source of selected amplitude and phase, the selection of amplitude and phase determining the configuration of the overall electromagnetic field produced by said transmitting conductors, there being a non-zero phase relationship between the voltage sources of at least two of said transmitting conductors;

alarm indicating circuitry coupled to said at least one receiving conductor for providing an alarm indication in response to predetermined disturbance of the electromagnetic field, and wherein said at least three transmitting conductors are operative to transmit a pulsed continuous wave signal.

28. Detection apparatus according to claim 27 and wherein said pulsed continuous wave signal is characterized in that the pulse width is sufficiently long such that transient effects are substantially absent.

29. Detection apparatus according to claim 27 or claim 28 and wherein said at least one receiving conductor includes a plurality of receiving conductors and said alarm indicating circuitry comprises a differential receiver coupled to said plurality of receiving conductors.

* * * * *